US005899186A

United States Patent [19]

Kawamoto

[11] Patent Number: 5,899,186

[45] Date of Patent: May 4, 1999

[54] INTERNAL COMBUSTON ENGINE OF SMALL PLANING WATERCRAFT

[75] Inventor: Yuichi Kawamoto, Akashi, Japan

[73] Assignee: Kawasaki Jukogyo Kabushiki Kaisha, Hyogo, Japan

[21] Appl. No.: 08/868,000

[22] Filed: Jun. 3, 1997

[30] Foreign Application Priority Data

Jun. 3, 1996 [JP] Japan ..... 8-139848

[51] Int. Cl.[6] ..... B63B 35/73

[52] U.S. Cl. ..... 123/196 R; 123/196 S; 184/6.5

[58] Field of Search ..... 123/196 R, 196 A, 123/196 S; 184/6.5, 6.13, 6.23

[56] References Cited

U.S. PATENT DOCUMENTS

| | | | |
|---|---|---|---|
| 4,501,234 | 2/1985 | Toki et al. | 123/196 R |
| 4,632,080 | 12/1986 | Hurner | 123/196 R |
| 4,667,628 | 5/1987 | Lopez-Crevillen | 123/196 R |
| 5,167,207 | 12/1992 | Gohara et al. | 123/196 S |
| 5,195,481 | 3/1993 | Oyama et al. | 123/196 R |
| 5,492,086 | 2/1996 | Kuhns | 123/195 C |
| 5,636,759 | 6/1997 | Brummer | 123/195 C |

FOREIGN PATENT DOCUMENTS 7-237587 9/1995 Japan .

*Primary Examiner*—Weilun Lo
*Attorney, Agent, or Firm*—Marshall, O'Toole, Gerstein, Murray & Borun

[57] ABSTRACT

An internal combustion engine mounted on a small planing watercraft 1 having a deck frame 40, a riders' seat 4 mounted removably on the frame 40, a propelling means, an internal combustion engine 20 for driving the propelling means through a coupling 46. The engine 20 includes, an oil receptacle 32 located at the bottom of the engine body and communicating with internal space of a crankcase, an oil tank 30 separated from the engine body is inserted from above through the opening of the deck frame 40 and removably fixed to the deck frame at a position away from the space above the coupling 46 which interconnects the engine and the propelling means. An engine oil collected in the oil receptacle 32 is transported to the oil tank 30 by means of a scavenging pump, and the oil in the oil tank 30 is supplied to various parts in the engine body by means of a feed pump.

10 Claims, 5 Drawing Sheets

INTERNAL COMBUSTON ENGINE OF SMALL PLANING WATERCRAFT

FIELD AND BACKGROUND OF THE INVENTION

The present invention relates to an internal combustion engine mounted on a small planing watercraft, and more particularly to an oil tank of a four-cycle internal combustion engine with a dry sump lubrication system.

A small planing watercraft is propelled to plane on the water usually by a two-cycle engine which is small in size and light in weight. Since the small planing watercraft is a sporty vehicle, the two-cycle engine which accumulates no engine oil in a crankcase has an advantage that no engine oil flows into a combustion chamber from the crankcase when the small planing watercraft turns over. The two-cycle engine, therefore, is suitable for mounting on a small planing watercraft.

In recent years, however, in view of environmental protection, a four-cycle engine of relatively low noise level and clean exhaust gas has been examined for mounting on a small planing watercraft. For engines of this type also, attempts are being made to apply a dry sump lubrication system wherein no engine oil is accumulated in the crankcase.

One of the attempts is disclosed in JP-A-7-237587. The publication shows a small planing watercraft and, mounted thereon a four-cycle engine for propelling the watercraft. An oil tank accumulating engine oil for lubricating the engine is located in a space above a coupling which interconnects an engine output shaft and an impeller shaft extending in a longitudinal direction of the hull. An oil pan formed at the bottom of the engine body and the oil tank are communicated with an oil pipe, and the engine oil collected in the oil pan is transferred to the oil tank through the oil pipe by means of an oil pump.

When the dry sump lubrication system is applied to the internal combustion engine of a small planing watercraft, a problem to be examined is where and how to mount the oil tank in a limited space. In particular, when the oil tank is separately mounted from the engine body, it is important to determine a mounting location and mounting manner of the oil tank so that the oil tank can be secured firmly, and mounting and dismounting of the oil tank as well as maintenance of the oil can easily be performed.

The oil tank shown in the above publication is mounted separately from the engine body, but the publication does not disclose any means for mounting the oil tank except for the rough mounting location (above the coupling) of the oil tank, and it is not clear on which structural member the oil tank is mounted, and how to perform the maintenance of the oil. The coupling used in a small planing watercraft is associated with rubber elements or the like, and requires relatively frequent maintenance and inspection. Therefore, the oil tank located above the coupling hinders the maintenance and inspection of the coupling.

The present invention has been developed in view of the above problems which have been posed when a four-cycle engine with a dry lubrication system is mounted on a small planing watercraft.

Accordingly, it is an object of the present invention to provide an engine of a small planing watercraft having advantages of the dry sump lubrication system.

Another object of the invention to provide a dry sump lubricating system, having an oil tank which is easy for inspection of the oil level and replenishing of the engine oil, and is easy for dismount, cleaning, and replacement of the engine oil, and is stably mounted.

SUMMARY OF THE INVENTION

The above-described objects are achieved by the present invention. Specifically, according to one aspect of the present invention, there is provided a four-cycle internal combustion engine with a dry sump lubrication system for mounting on a small planing watercraft, which includes a deck frame and a riders' seat mounted removably on the frame, the deck frame having an opening formed under the seat, the internal combustion engine comprising: an engine body (a housing of the internal combustion engine including a cylinder head, a cylinder block, a crankcase) having a crankcase; an oil receptacle located at the bottom of the engine body and communicating with the internal space of the crankcase; an oil tank being separated from the engine body, said oil tank being inserted from above through the opening of the deck frame into the internal space of the deck frame and being removably fixed to the deck frame; an oil passage for transporting an engine oil collected in the oil receptacle to said oil tank by means of a scavenging pump; and an oil passage for supplying the engine oil from the oil tank to various parts in the engine body by means of a feed pump.

This engine is applied to a dry sump lubricating system in which the engine oil is accumulated not in the crankcase, but in a separately mounted oil tank. Therefore, the engine has the following advantages: (a) Power loss and oil mist scattering due to the contact of rotating members such as a crankshaft with the accumulated oil surface are restrained. (b) Mounting position of the engine can be lowered because an oil pan is not necessary. Therefore, the center of gravity of the watercraft can be lowered. (c) Vertical size of the engine can be reduced. (d) Fluctuation of the oil surface in the oil tank due to quick acceleration and deceleration, sharp turns, pitching or rolling can be reduced. Therefore, the optimum amount of the engine oil is constantly supplied to various parts of the engine without sucking air. (e) Temperature rise of the engine oil is restrained because the oil in the oil tank is not agitated. (f) Even when the watercraft turns over, substantial quantity of the engine oil in the oil tank is retained, therefore, the condition in the oil tank is recovered and the engine is easily restarted after the watercraft is restored in normal position.

Since the small planing watercraft is a sporty vehicle and mounting space is restricted, a small size and high power engine is required. Therefore, the advantages (a)–(f) are favorable for the small planing watercraft. In particular, being able to lower the center of gravity of the watercraft, as described above at (b) and (c) is an important advantage for enhancing stability of the watercraft. Furthermore, the dry sump lubrication system prevents the engine oil from entering into the combustion chamber when the watercraft is turns over, and the engine is easily restarted after it is restored.

The oil tank of the engine is inserted in the internal space of the deck frame which tends to be a dead space, therefore, by effectively utilizing this space a sufficient tank capacity is secured. Furthermore, the deck frame is a strong structural member constituting a seat support member and a backward outer shell of the small planing watercraft, the oil tank mounted thereto is firmly secured in stable condition. In addition, by removing the riders' seat, the oil tank is exposed, therefore, the inspection of the engine oil quantity and the replenishment of the engine oil can easily be conducted. Furthermore, the oil tank is easily dismounted for cleaning the inside thereof or oil replacing, because the oil tank is inserted into the opening from above and secured to the deck frame.

According to the second aspect of the invention, the oil tank is inserted into the opening and fixed to the deck frame at the position away from the internal space above the coupling which interconnects the engine and the propelling means. With this configuration, the oil tank does not hinder the accessibility to the coupling which requires relatively frequent maintenance and inspection.

According to the third aspect of the invention, the oil tank is bolted to the deck frame through a vibration isolating member. With this configuration, vibration to the oil tank and to the conduits connected thereto is suppressed. In addition, the oil tank is easily dismounted in a vertical direction by removing the bolts.

According to the fourth aspect of the invention, the oil tank has an opening at the upper part thereof for filling the engine oil, and the opening is closed with a cap having a level gauge. With this configuration, the engine oil is easily refilled by removing the cap checking the oil level with the gauge attached to the cap.

According to the fifth aspect of the invention, the upper part of the oil tank is communicated with an air suction device of the engine by a breather pipe arranged by way of the height in the neighborhood of the bottom of the oil tank. With this configuration, while discharging a blow-by gas which is introduced with the engine oil into the oil tank, the engine oil in the oil tank is prevented from flowing out when the watercraft turns over. Therefore, the consumption of the engine oil is restricted. Namely, the portion of breather pipe at the neighborhood of the bottom of the oil tank rises above the oil surface when the watercraft turns over and the oil tank is reversed. Therefore, the engine oil in the oil tank is prevented from flowing out through the breather pipe.

According to the sixth aspect of the invention, a valve is arranged in the breather pipe communicated between the upper part of the oil tank and the air suction device of the engine to close the passage when the small planing watercraft turns over. With this configuration, the valve can prevent the engine oil in the oil tank from flowing out minimizing consumption of the engine oil when the watercraft turns over. In addition, the detouring of the breather pipe, as in the fifth aspect of the invention, can be omitted and thereby the fabrication of the breather pipe can be simplified. Furthermore, the engine oil is prevented from flowing into the combustion chamber through the breather pipe when the watercraft turns over, therefore, the engine can easily be restarted after the watercraft is restored to its normal position.

According to the seventh aspect of the invention, the oil tank includes an oil mist separating fin arranged on the inner surface thereof. With this construction, the oil mist in the blow-by gas introduced with the engine oil from the crankcase is separated and recovered as oil drops thereby prevents the decrease of engine oil quantity in the oil tank and also prevents the contamination of the breather pipe.

DETAILED DESCRIPTION OF THE EMBODIMENT

Figure 1:
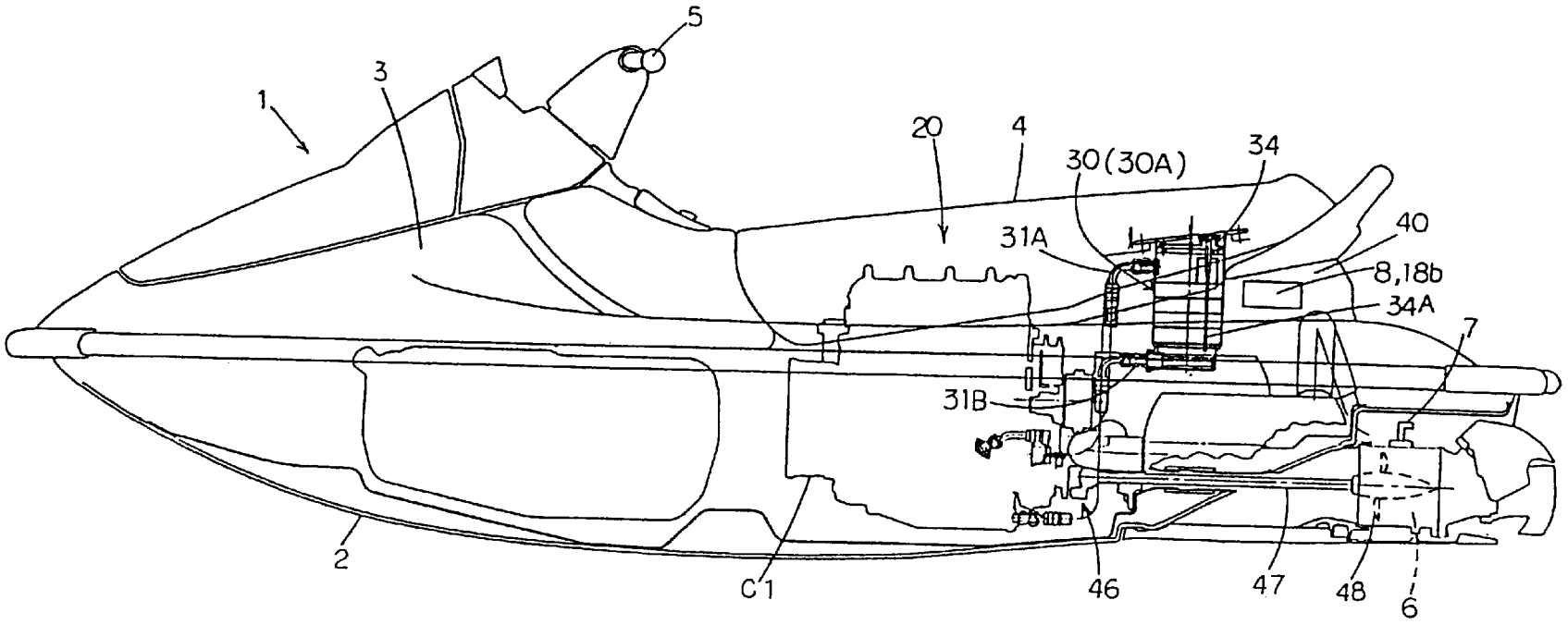
FIG. 1 is a partially perspective side view of a small planing watercraft having mounted thereon a four-cycle four-cylinder internal combustion engine according to the invention.

An internal combustion engine for a small planing watercraft according to the present invention will be explained in detail below with reference to the accompanying drawings.

First, a small planing watercraft 1 will be described with reference to FIG. 1. The small planing watercraft 1 is a watercraft for planing on the water near the sea coast or the lake coast. The watercraft comprises a hull 2, a deck 3, a seat 4, and steering bars 5 mounted on the hull 2, and can accomodate on board one or several persons. The small planing watercraft 1 planes on the water surface by a propulsion of water jet pressurized and ejected rearward by an impeller 48 of a water jet pump 6 mounted on the bottom of its stern. The impeller 48 is driven by a four-cycle four-cylinder internal combustion engine 20 mounted substantially at the central portion of the hull 2, and includes a dry sump lubrication system by separately mounting an oil tank 30 to a deck frame 40 constituting a reaward outer cell of the deck 3, on which the seat 4 is mounted. The output of the engine 20 is transmitted to the drive shaft 47 through the coupling 46 with a rubber element for rotating the impeller 48 by the drive shaft 47.

Next, the structure of the engine 20 will be described with reference to FIGS. 1 and 4. The engine 20 is a four-cycle four-cylinder engine and includes, from top to down, a cylinder head 21, a cylinder block 25 and a crankcase 29. The cylinder head 21 has formed therein an air intake passage 22 and an exhaust passage 23. Valves for opening and closing the passages 22, 23 are installed in the cylinder head 21 together with mechanisms 24 for driving the valves. An air suction device 120 including an air intake manifold 12 with a carburetor 12A and an intake silencer 11 are connected upstream of the air intake passage 22, while a muffler 13 is connected downstream of the exhaust gas passage 23. Also, a piston 26 is slidably arranged in a cylinder liner 25A of the cylinder block 25. The space surrounded by the cylinder liner 25A, the piston 26 and the cylinder head 21 defines a combustion chamber 27.

The piston 26 is coupled to a crankshaft 28 supported on a crankcase 29 through bearings (not shown).

Figure 2:
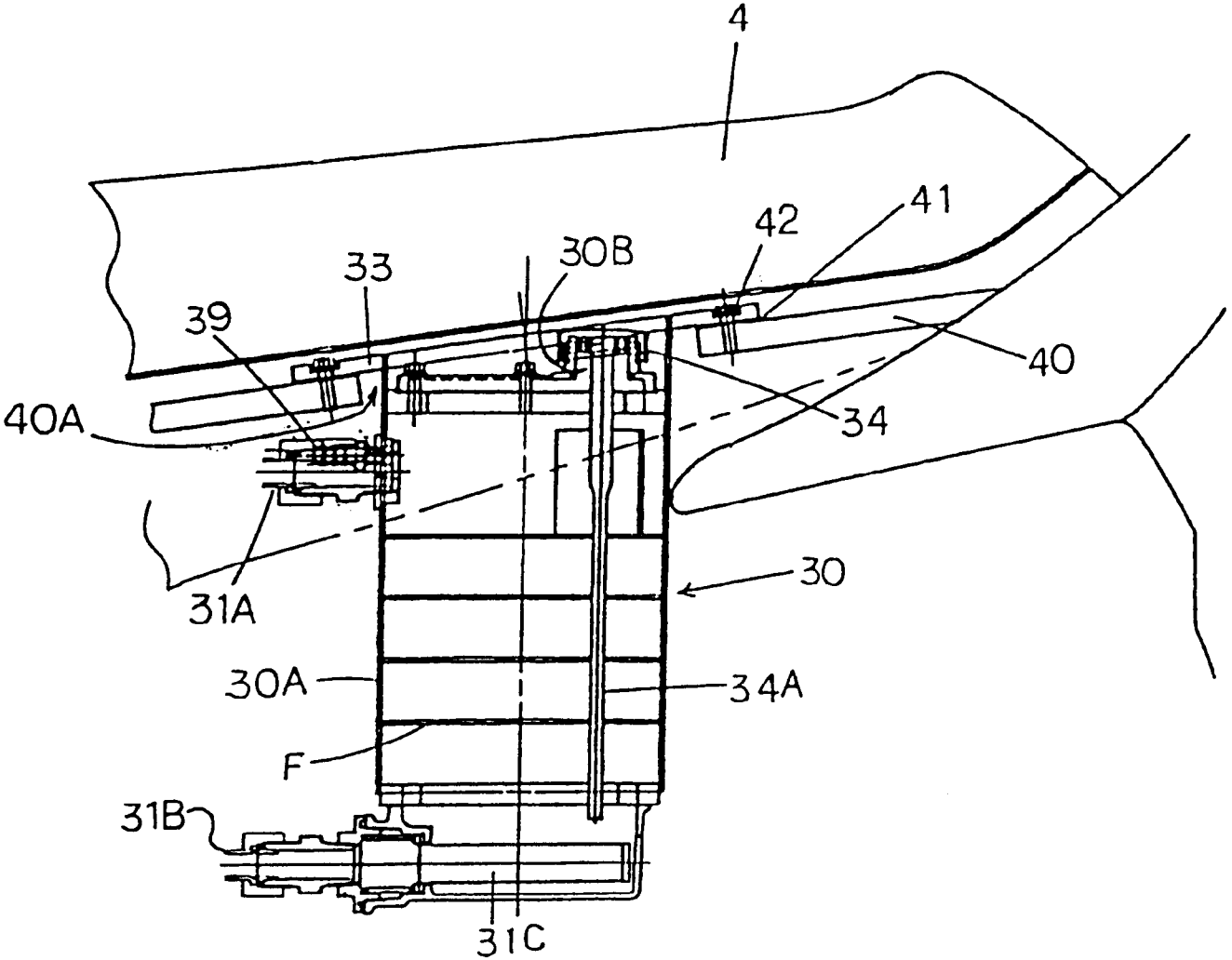
FIG. 2 is an enlarged broken side view of a part of the small planing watercraft, where the oil tank of the engine is mounted.

The crankcase 29 has a cylindrical wall 29W with substantially inverted-Ω shaped cross section extending in the longitudinal direction of the crank shaft 28 defining the space in which the crankshaft 28 is allowed to rotate. An oil receptacle 32 is integrally formed with the bottom of the cylindrical wall 29W protruding to the muffler side of the engine and communicated with the internal space of the crankcase 29. The oil receptacle 32 is arranged such that the lowest portion thereof is slightly lower than the lowest portion 29B of the cylindrical wall 29W. The engine oil supplied to various parts of the engine for lubrication and dropping from bearings and others, is collected in the oil receptacle 32. The engine oil collected in the oil receptacle 32 is transported to the oil tank 30 by a scavenging pump P1 through a strainer 35 to remove relatively large foreign matter, and through an oil passage 29C formed in the crankcase 29 and others, and through a conduit 31A. The engine oil in the oil tank 30 is supplied by a feed pump P2 (located at the same position as the pump P1 in FIG. 4) to the various parts of the engine for lubrication through a fine strainer 31C (FIG. 2). A conduit 31B and oil passages are formed in such a manner as described above. The pumps P1 and P2 are constituted as a tandem trochoidal type rotated by a driven gear G2 which is driven by a drive gear G1 mounted on the crankshaft 28. Of course, the pumps P1 and P2 can, in place of a trochoid pump, be constituted as another type such as internal gear pumps or external gear pumps. The engine oil is cooled by an oil cooler 36 arranged on the crankcase 29 to maintain the oil at a predetermined temperature. The oil receptacle 32 is formed integrally a bottom lateral portion of the crankcase 29 to eliminate an oil pan, to especially lower the engine height and then to lower the center of gravity of the small planing watercraft 1.

Figure 3:
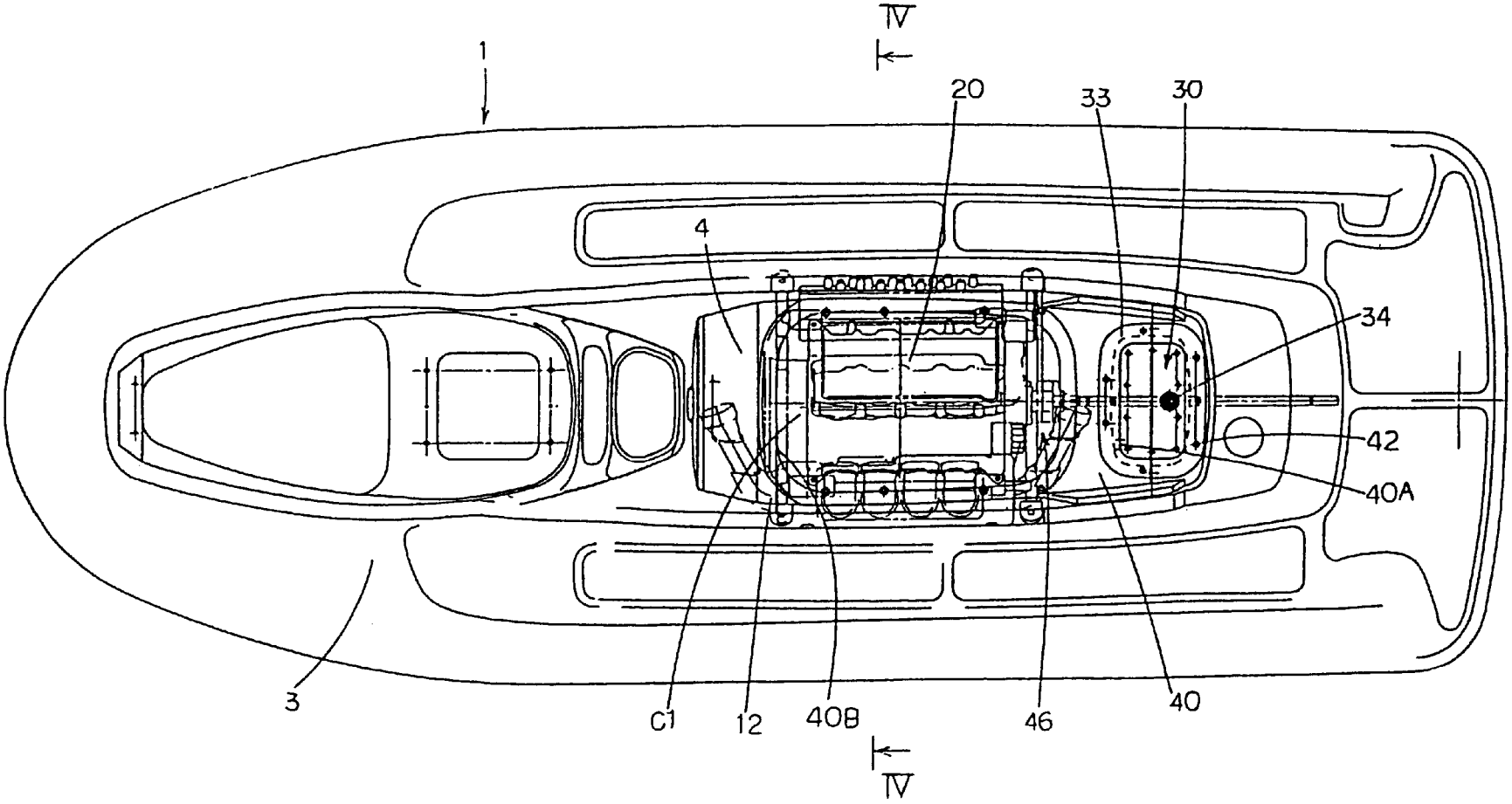
FIG. 3 is a plan view of the small planing watercraft, with the riders' seat removed.

As shown in FIGS. 1–3, the oil tank 30 is generally formed as a generally rectangular container 30A having an opening 30B at a top wall thereof for filling the engine oil. The opening 30B is closed with a cap 34 having a level gauge 34A. A plurality of rib-like oil mist separating fins F are formed on the inner wall of the oil tank 30 for separation of the engine oil and the blow-by gas brought into the oil tank 30 from the crankcase 29 as well as for reinforcement of the wall of the oil tank 30. The fins F submerged in the engine oil function to suppress large fluctuations of the oil level against turning, rolling and pitching of the small planing watercraft 1. An opening 40A is formed on the rear portion of the deck frame 40 away from the position just above the coupling 46. The oil tank 30 is inserted through the opening 40A from above. A flange 33 attached to the top end of the oil tank 30 is fixed to the deck frame 40 by bolts 42 through vibration isolating members 41. Thus, the oil tank 30 is accommodated in the dead space inside of the deck frame and stably fixed to the deck frame 40. An inflow conduit 31A is connected to the upper portion of the side wall of the oil tank 30 near its top, through which the engine oil is transferred from the oil receptacle 32 to the oil tank 30 by the scavenging pump P1. An outflow conduit 31B is connected to the bottom of the oil tank 30 at which a fine strainer 31C is disposed and the engine oil in the oil tank 30 is transferred to the feed pump P2 through the strainer 31C and the conduit 31B.

A breather pipe 39 is connected to the upper portion of the side wall of the oil tank 30 that a first upper end of the breather pipe is approximately at the same height as the inflow conduit 31A.

The breather pipe 39 has a second lower end which communicates with the air intake manifold 12 through a generator case C1 or inside of the cylinder head cover 21A (or directly with the air intake manifold 12). A breather pipe portion between the first upper end and the second lower end passes in the neighborhood of and approximately at the same height as the bottom of the oil tank 30, for ventilating the oil tank 30 and sending the blow-by gas separated in the tank 30 into the combustion chambers 27 through the air intake manifold 12 while the engine is in operation. Consequently, when the watercraft 1 turns over and the tank 30 is inverted, the breather pipe 39 portion located near the bottom of and approximately at the same height as the oil tank 30 is then positioned above the oil level, therefore, the engine oil is prevented from flowing out through the breather pipe 39.

As described above, the opening 40A of the deck frame 40 for mounting the oil tank 30 is located immediately at the rear of the opening 40B located just above the engine 20, as shown in FIG. 3. Connection and disconnection of the oil conduits 31A, 31B and the breather pipe 39 (FIG. 2) can be performed through the opening 40B. Maintenance and inspection of the engine 20 and coupling 46 is performed through the opening 40B.

Figure 4:
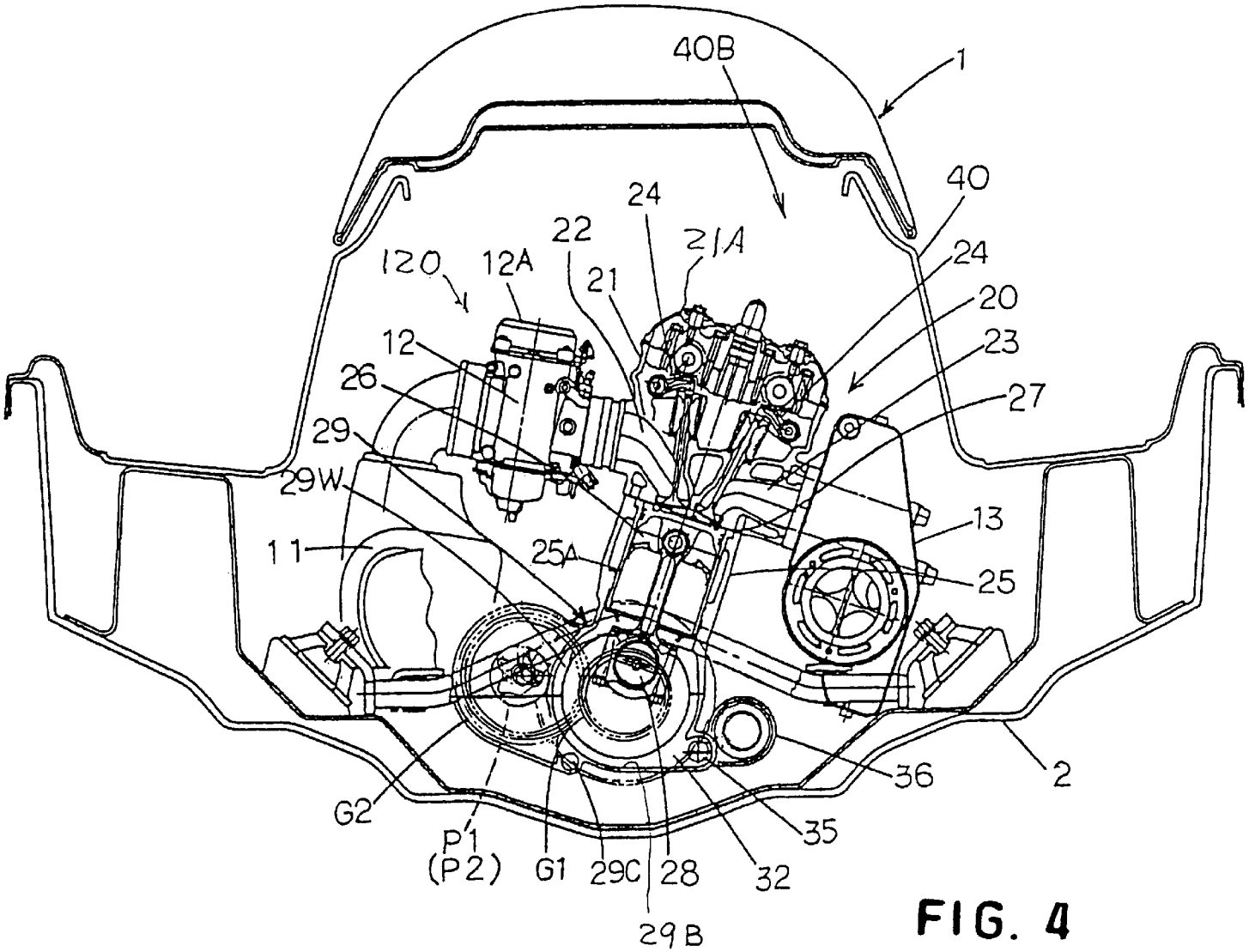
FIG. 4 is a cross section taken along line IV—IV of FIG. 3.
Figure 5A:
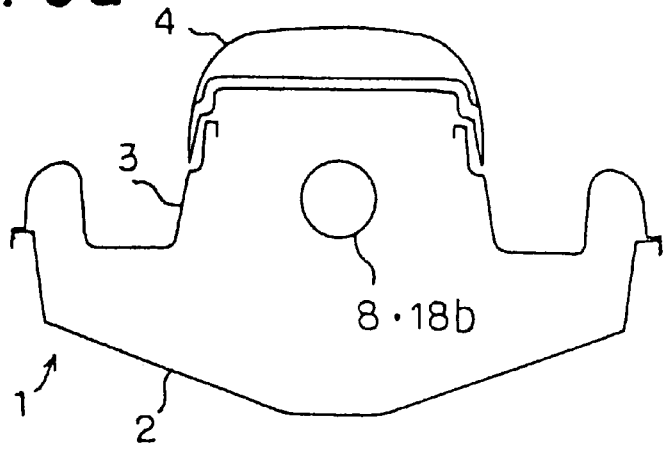
FIG. 5 shows a turn-over switch of a small planing watercraft, in which FIG. 5(*a*) is a schematic diagram showing a layout of the turn-over switch in the cross sectional view of the small planing watercraft, FIG. 5(*b*) is a circuit diagram showing the connections of the ignition device and the turn-over switch, and FIG. 5(*c*) is a schematic diagram showing a configuration of the turn-over switch.
Figure 5B:
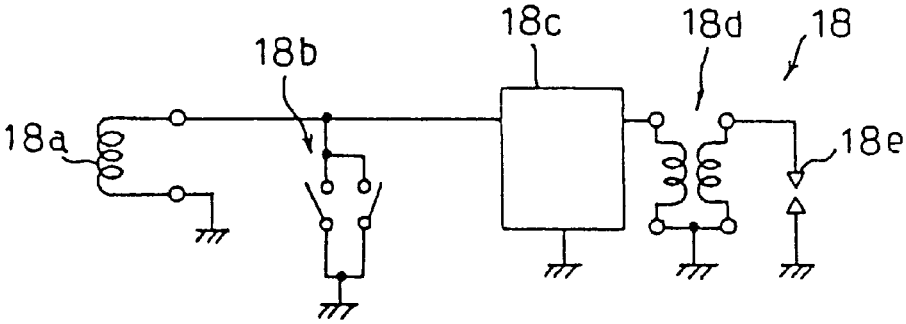
Figure 5C:
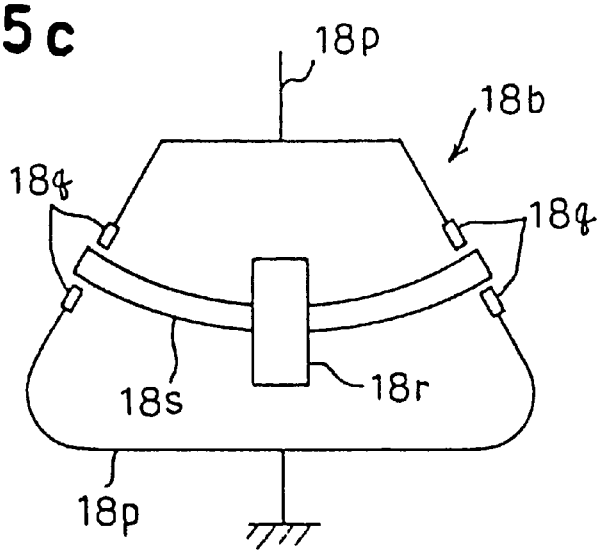

As a unique feature, the small planing watercraft 1 is equipped with a turn-over detection switch 18*b*, as shown in FIGS. 5(*a*) to 5(*c*), for automatically stopping the engine 20 in case it turns over. As shown in FIG. 5(*a*) and FIG. 1, the turn-over detection switch 18b is mounted in an electrical equipment box 8 (a sufficiently waterproof hermetic box to encase the electrical parts that are not waterproof) arranged inside the hull 2 of the small planing watercraft 1. The turn-over detection switch 18*b* is connected to an ignition system 18 of the engine 20 as shown in FIG. 5(*b*). In FIG. 5(*b*), an exciter coil 18*a*, a CDI (Capacitive Discharge Ignition) unit 18*c*, an ignition coil 18*d* and an ignition plug 18*e* constitute the ignition system 18. The turn-over switch 18*b* of weight type as shown in FIG. 5(*c*) is employed. Specifically, the circuit shown with a wire 18*p* having a grounded end includes a pair of laterally (in the transverse direction of the hull) symmetric open contacts 18*q*, and a weight 18*r* is arranged slidably along a U-shaped track 18*s* formed between the contacts 18*q*. When the track 18*s* is tilted leftward or rightward at a predetermined angle (say, 60°) or more, the weight 18*r* that has correspondingly moved, comes into contact with one of the contacts 18*q* to close the circuit. Then, the output from the exciter coil 18*a* of the ignition system 18 shown in FIG. 5(*b*) thus is grounded to stop the engine 20. Thus, when the watercraft 1 turns laterally or turns over, the engine 20 as well as the feed pump P2 immediately stops thereby to stop supplying the engine oil to the crankshaft 28 (FIG. 4) and others. As a result, the engine oil is prevented from flowing into the crankcase 29 and further into the combustion chamber 27 when the small planing watercraft 1 turns over. Other types of switches can of course be used as a turn-over switch.

When the breather pipe 39 (FIG. 2) is equipped with a solenoid valve (not shown) controlled to open and close by the turn-over detection switch 18*b* (FIG. 5), the breather pipe 39 (FIG. 2) may communicate with the suction manifold 12 through the generator case C1, through the cylinder head cover 21A and the like, by eliminating the detour piping of the breather pipe as mentioned above. Therefore, breather pipe 39 can be considerably reduced in length and simplified. In addition, the engine 20 as well as the feed pump P2 is stopped when the watercraft 1 turns over, and at the same time the solenoid valve is closed to prevent the engine oil from flowing out and entering into the combustion chamber 27, thus, the engine 20 can be easily restarted after the watercraft 1 is restored to its normal position.

Further, a cooling water passage or water jacket (not shown) may be formed on the peripheral wall of the oil tank 30 to introduce cooling water from a water intake fitting 7 mounted on the water jet pump 6 shown in FIG. 1. Specifically, one port of the jacket may be connected to the fitting 7 through a cooling water passage (not shown), and in the same manner, the other port may be connected to the cooling water coupling port (not shown) of the cylinder block 25 (FIG. 4) through a tube (not shown). The water from the water jet pump 6 is thus delivered to cool the cylinder block 25 and cylinder head 21 after cooling the oil tank 30. A cooling coil (not shown) may be disposed in the oil tank 30 to cool the engine oil in cooperation with the water jacket. The engine 20 and the oil tank 30 are mounted in the closed space surrounded by the bottom hull 2 and the deck 3, as shown in FIG. 1, and are therefore not air-cooled even while the watercraft is running. Nevertheless, the engine 20 and the oil tank 30 are effectively cooled by the water-cooled structure described above.

The engine 20 is so arranged in the hull 2, as shown in FIG. 4, that the crankshaft 28 is directed in the longitudinal direction of the hull 2 on the central position of the hull width, and all cylinders 25 of the engine 20 are inclined to the right side of the hull 2(starboard). By inclining cylinders 25 to the right side of the hull 2, an accommodating space for the air suction device 120 is secured in the upper left portion of the cylinders 25. The carburetor 12A and other devices are arranged at above proximity of the cylinder 25. The deflection of the weight of the engine 20 to the right side of the hull 2 is minimized by adjusting the arrangement of the suction devices 120. Therefore, by positioning the crankshaft 28 in the center of the hull width, the center of gravity of the whole watercraft is positioned substantially at the center in the traverse direction of the hull 2. With such arrangement, the four cycle engine 20 together with suction devices, which is larger and heavier than a two cycle engine, can be arranged in a limited internal space of the small planing watercraft optimizing weight distribution thereof.

I claim:

1. An internal combustion engine for driving a propelling means of a small planing watercraft through a coupling interconnecting the engine and the propelling means, said watercraft includes a deck frame defining an internal space and a riders' seat mounted removably on the deck frame, the internal combustion engine comprising;

an engine body having a crankcase;

an oil receptacle located at the bottom of the engine body and communicating with the interior of the crankcase;

an oil tank being separated from the engine body, said tank being inserted from above through an opening formed in the deck frame under the riders' seat, and said oil tank being removably fixed to the deck frame under the rider's seat at a readily accessible position in the internal space of the deck frame spacially separated from and rearward of the internal space directly above the coupling which interconnects the engine and the propelling means;

a first oil passage for transporting engine oil collected in the oil receptacle to said oil tank by means of a scavenging pump; and a second oil passage for supplying engine oil from the oil tank to various parts in the engine body by means of a feed pump.

2. An internal combustion engine for the small planing watercraft according to claim 1, wherein the upper part of said oil tank is communicated with an air suction device of the engine by a breather pipe, and including a valve and a turn over detection switch, wherein the valve is controlled to open and close by the turn over detection switch, and wherein the valve is arranged in the breather pipe communicated between the upper part of said oil tank and the air suction device of the engine to close the pipe when the small planing watercraft turns over.

3. An internal combustion engine for the small planing watercraft according to claim 1, wherein the oil tank is bolted to the deck frame through a vibration isolating member.

4. An internal combustion engine for the small planing watercraft according to claim 1, wherein said oil tank has an opening at the upper part thereof for filling the engine oil, and said opening is closed with a cap having a level gauge.

5. An internal combustion engine for the small planing watercraft according to claim 1, wherein the upper part of said oil tank is communicated with an air suction device of the engine by a breather pipe passing approximately at the height of the bottom of said oil tank, whereby the breather pipe being positioned above the oil level when the oil tank is inverted.

6. An internal combustion engine for the small planing watercraft according to claim 1, wherein said oil tank includes at least one fin being formed horizontally on the inner surface of the oil tank at the height between an inlet and an outlet of the oil tank.

7. An internal combustion engine for the small planning watercraft according to claim 6, including a plurality of fins formed horizontally on the inner surface of oil tank, and wherein at least one fin is submerged in the oil in the oil tank.

8. An internal combustion engine for driving a propelling means of a small planing watercraft, which includes a deck frame and a riders' seat mounted removably on the frame, the deck frame having a first opening for inspection and maintenance formed under the seat, the internal combustion engine comprising:

an engine body having a crankcase;

an oil receptacle located at the bottom of the engine body and communicating with the internal space of the crankcase;

an oil tank being separated from the engine body, said tank being inserted from above through a second opening formed in the deck frame under the riders' seat, and said oil tank being removably fixed to the deck frame under the riders' seat at the rearward of the first opening of the deck frame for ready maintenance and inspection;

a first oil passage for transporting engine oil collected in the oil receptacle to said oil tank by means of a scavenging pump; and a second oil passage for supplying engine oil from the oil tank to various parts in the engine body by means of a feed pump.

9. An internal combustion engine for driving a propelling means of a small planing watercraft through a coupling interconnecting the engine and the propelling means, said watercraft includes a deck frame defining an internal space and a riders' seat mounted removably on the deck frame, the internal combustion engine comprising;

an engine body having a crankcase;

an oil receptacle located at the bottom of the engine body and communicating with the interior of the crankcase;

an oil tank being separated from the engine body, said tank being inserted from above through an opening formed in the deck frame under the riders' seat, and said oil tank being removably fixed to the deck frame under the rider's seat at a readily accessible position in the internal space of the deck frame spacially separated from the internal space directly above the coupling which interconnects the engine and the propelling means, whereby the top of the oil tank is exposed when the seat is removed;

flange means for removably suspending the oil tank from the deck frame under the riders' seat;

a first oil passage for transporting engine oil collected in the oil receptacle to said oil tank by means of a scavenging pump; and a second oil passage for supplying the engine oil from the oil tank to various parts in the engine body by means of a feed pump.

10. An internal combustion engine for the small planing watercraft according to claim 9, including;

(1) a flange extending beyond the opening is attached to the top end of the oil tank, and (2) the oil tank is inserted through the opening from the above, and the flange is fixed to an upper surface of the deck frame for removably suspending said oil tank from the deck frame.

* * * * *